US011679289B2

(12) United States Patent
Shin

(10) Patent No.: US 11,679,289 B2
(45) Date of Patent: Jun. 20, 2023

(54) FIRE SUPPRESSION SYSTEM FOR VEHICLE

(71) Applicants: HYUNDAI MOTOR COMPANY, Seoul (KR); KIA MOTORS CORPORATION, Seoul (KR)

(72) Inventor: Hyeon Gi Shin, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 165 days.

(21) Appl. No.: 17/114,974

(22) Filed: Dec. 8, 2020

(65) Prior Publication Data

US 2021/0308508 A1 Oct. 7, 2021

(30) Foreign Application Priority Data

Apr. 7, 2020 (KR) ..... 10-2020-0041878

(51) Int. Cl.

| | |
|---|---|
| ***A62C 3/07*** | (2006.01) |
| ***A62C 35/60*** | (2006.01) |
| ***A62C 35/68*** | (2006.01) |
| ***A62C 37/36*** | (2006.01) |

(52) U.S. Cl.

CPC ..... *A62C 3/07* (2013.01); *A62C 35/60* (2013.01); *A62C 35/68* (2013.01); *A62C 37/36* (2013.01)

(58) Field of Classification Search

CPC ..... A62C 3/07; A62C 35/60; A62C 35/68; A62C 37/36

USPC ..... 169/62, 70

See application file for complete search history.

(56) References Cited

U.S. PATENT DOCUMENTS 4,047,572 A * 9/1977 Stary ..... A62C 3/00 169/70

FOREIGN PATENT DOCUMENTS

| | | | |
|---|---|---|---|
| CN | 103826706 | A | 5/2014 |
| CN | 205683431 | U | 11/2016 |
| CN | 106913978 | A | 7/2017 |
| CN | 108698323 | A | 10/2018 |
| CN | 109552080 | A | 4/2019 |
| CN | 208770716 | U | 4/2019 |
| CN | 109764188 | A | 5/2019 |
| CN | 210020934 | U | 2/2020 |

* cited by examiner

*Primary Examiner* — Christopher S Kim

(74) *Attorney, Agent, or Firm* — Morgan, Lewis & Bockius LLP

(57) ABSTRACT

A fire suppression apparatus for a vehicle includes: a docking unit disposed on an exterior panel of a vehicle body, the exterior panel configured to cover an interior space of the vehicle wherein the docking unit comprises a hole through which a fire-fighting hose or a spray nozzle, which is connected to the fire-fighting hose, for supply of fire-fighting water pass to be coupled to the docket unit; a supply pipe having a first end connected to the docking unit; and a nozzle assembly arranged in the interior space in the vehicle and connected to a second end of the supply pipe, the nozzle assembly being configured to spray the fire-fighting water, which is supplied through the supply pipe from the fire-fighting hose or the spray nozzle, in order to respond to the outbreak of a fire in the interior space of the vehicle.

14 Claims, 10 Drawing Sheets

FIRE SUPPRESSION SYSTEM FOR VEHICLE

CROSS-REFERENCE TO RELATED APPLICATION

This application claims the benefit of priority to Korean Patent Application No. 10-2020-0041878 filed on Apr. 7, 2020 in the Korean Intellectual Property Office, the entire contents of which are incorporated herein by reference.

TECHNICAL FIELD

The present disclosure relates to a fire suppression apparatus for a vehicle. More particularly, the present disclosure relates to a fire suppression apparatus for a vehicle, capable of promptly responding to an outbreak of a fire in an interior space of the vehicle by connecting a fire-fighting hose or a spray nozzle to an exterior panel of the vehicle and then injecting fire-fighting water.

BACKGROUND

In conventional internal combustion engine vehicles, a flammable substance such as fuel is used, multiple heat sources are present, and various electrical wires are connected in the state of being tangled. Hence, there is a high risk of a fire.

For example, an engine room of a vehicle accommodates a high-temperature engine and various electrical devices, and thus, a fire may break out due to breakage or malfunction of an engine or electrical devices in the event of a collision.

Furthermore, there is also the risk of fire in the engine room when traveling normally due to overheating of the engine or problems with post treatment of exhaust gas.

In recent years, as eco-friendly vehicles such as electrical vehicles have become widely adopted, a risk of a battery or a high-voltage electrical wire catching fire due to an external impact or internal short circuit has also increased.

As an approach to dealing with a fire in a vehicle, an approach of providing a vehicle with a fire extinguisher is predominantly known. When a driver does not use the fire extinguisher in time, the attempt to extinguish the fire may fail, and thus the fire may spread throughout the vehicle.

Particularly, it is essential to prevent a fire in a vehicle transporting a large number of passengers such as buses. When a fire occurs in such a vehicle, the fire is likely to lead to a great tragedy.

In addition, because a driver is located inside the vehicle during traveling of the vehicle, when the interior space such as an engine room catches fire, there are many cases in which it is impossible to quickly recognize the outbreak of the fire until a large amount of smoke is generated. Furthermore, because a bus has an engine room positioned at the rear part of the bus, unlike a passenger automobile, it is even more difficult for a driver to recognize the outbreak of a fire in the engine room.

Hence, a driver cannot respond to a fire in the early stages thereof, and thus the fire may spread, thereby completely destroying the vehicle and increasing the risk of harm to humans.

Even when a driver or a passenger in the vehicle quickly recognizes a fire outbreak, it is difficult to suppress the fire using only a relatively small-sized fire extinguisher provided in the vehicle.

In a state in which a fire hydrant is located near a vehicle that catches fire or in which a fire truck arrives at the scene of a fire, it is possible to extinguish the fire by spraying fire-fighting water to the vehicle. However, when the interior space in the vehicle catches fire, the following problems may occur.

In order to extinguish a fire in an engine room, which is positioned at a rear side of a bus, fire-fighting water must be sprayed toward the inside of the engine room after a flap door covering the engine room is opened. The reason for this is because the flap door hermetically closes the engine room. Specifically, because the interior space in the engine room is enclosed by the flap door, it is impossible to sprinkle fire-fighting water to the engine room without opening the flap door.

However, a large amount of air is instantaneously introduced into the engine room when the flap door is opened in order to extinguish the fire, and therefore, the fire may rapidly spread, and a fire fighter who is suppressing the fire may be endangered.

The information included in this Background section is only for enhancement of understanding of the general background of the present disclosure and may not be taken as an acknowledgement or any form of suggestion that this information forms the prior art already known to a person skilled in the art.

SUMMARY OF THE DISCLOSURE

The present disclosure has been made in an effort to solve the above-described problems associated with the prior art. It is an object of the present disclosure to provide a fire suppression apparatus for a vehicle, which is capable of quickly and efficiently suppressing the outbreak of fire in an interior space such as an engine room in the vehicle by simply connecting a fire-fighting hose or a spray nozzle to a docking unit without opening a flap door of the vehicle.

In one aspect, the present disclosure provides a fire suppression apparatus for a vehicle including: a docking unit disposed on an exterior panel of a vehicle body, the exterior panel configured to cover an interior space of the vehicle wherein the docking unit comprises a hole through which a fire-fighting hose or a spray nozzle, which is connected to the fire-fighting hose, for supply of fire-fighting water pass to be coupled to the docket unit; a supply pipe having a first end connected to the docking unit; and a nozzle assembly arranged in the interior space in the vehicle and connected to a second end of the supply pipe, the nozzle assembly being configured to spray the fire-fighting water, which is supplied through the supply pipe from the fire-fighting hose or the spray nozzle, in order to respond to the outbreak of a fire in the interior space of the vehicle.

Other aspects and embodiments of the disclosure are discussed infra.

It is understood that the term "vehicle" or "vehicular" or other similar term as used herein is inclusive of motor vehicles in general, such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example one powered both gasoline and electricity.

The above and other features of the disclosure are discussed infra.

BRIEF DESCRIPTION OF THE DRAWINGS

The above and other features of the present disclosure will now be described in detail with reference to certain exemplary embodiments thereof, illustrated in the accompanying drawings which are given hereinbelow by way of illustration only, and thus are not limitative of the present disclosure, and wherein.

Figure 1:
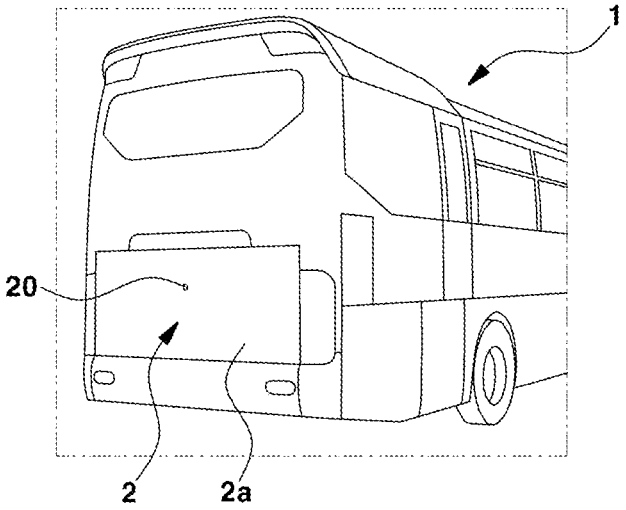
FIG. 1 is a view illustrating a rear flap door of a bus to which a fire suppression apparatus according to an embodiment of the present disclosure is applicable.

It should be understood that the appended drawings are not necessarily to scale, presenting a somewhat simplified representation of various features illustrative of the basic principles of the disclosure. The specific design features of the present disclosure as disclosed herein, including, for example, specific dimensions, orientations, locations, and shapes, will be determined in part by the particular intended application and use environment.

In the figures, reference numbers refer to the same or equivalent parts of the present disclosure throughout the several figures of the drawing.

DETAILED DESCRIPTION

Hereinafter, reference will now be made in detail to various embodiments of the present disclosure, examples of which are illustrated in the accompanying drawings and described below. While the disclosure will be described in conjunction with exemplary embodiments, it will be understood that the present description is not intended to limit the disclosure to those exemplary embodiments. On the contrary, the disclosure is intended to cover not only the exemplary embodiments, but also various alternatives, modifications, equivalents and other embodiments that fall within the spirit and scope of the disclosure as defined by the appended claims.

Hereinafter, embodiments of the present disclosure will be described in detail with reference to the accompanying drawings so as to be easily embodied by those skilled in the art to which the present disclosure belongs. However, the present disclosure is not limited to the embodiments disclosed herein, and may be embodied into various modification and variations.

When a part is disclosed as "including" a component throughout this specification, the part should be understood not to exclude the presence or possibility of presence of other components but to further include such other components unless otherwise defined.

The present disclosure provides a fire suppression apparatus capable of quickly and efficiently suppressing a fire that breaks out in an interior space such as an engine room of a vehicle by simply connecting a fire extinguishing hose or a spray nozzle to the vehicle without opening a flap door.

Although the vehicle to which the fire suppressing apparatus according to the present disclosure is applied may be a bus, the vehicle is not limited to the bus and may be a passenger automobile.

Here, the flap door may be the rear flap door of a bus, which is configured to cover an engine room positioned at the rear side of the bus. In the case of a passenger automobile in which an engine room is positioned at a front side of a vehicle, the flap door may be replaced with a hood, which hermetically covers the engine room.

In the present disclosure, any one of the flap door and the hood includes the exterior panel of a vehicle body. The exterior panel of a vehicle is a panel constituting the flap door or the hood, which is provided so as to cover the interior space such as an engine room provided in the vehicle.

The present disclosure is characterized in that an exterior panel of a vehicle is provided with a docking unit with which a fire hydrant or a fire-fighting hose or a spray nozzle of a fire truck is docked.

Consequently, when a fire breaks out, it is possible to supply fire-fighting water to the interior space (an engine room) of a vehicle, which is covered by an exterior panel of the vehicle, by simply connecting a fire-fighting hose or a spray nozzle to the docking unit in the exterior panel of the vehicle and supplying fire-fighting water thereinto, thereby extinguishing the fire in the interior space even without opening the flap door or the hood.

Furthermore, according to the present disclosure, since a fire-fighting hose or a spray nozzle is capable of being connected to the docking unit of the vehicle and held thereby, a firefighter does not need to hold and carry the fire-fighting hose or the spray nozzle connected to the docking unit in order to supply fire-fighting water to put out the fire.

As a result, since it is possible to extinguish a fire in the interior space in the state in which a fire is hermetically covered by the flat door and air supply thereto is blocked, it is easy to extinguish the fire, and it is possible to prevent a firefighter from being exposed to danger while putting out the fire.

Hereinafter, the construction of the fire suppression apparatus according to the embodiment of the present disclosure will be described in detain with reference to the accompanying drawings.

Figure 2A:
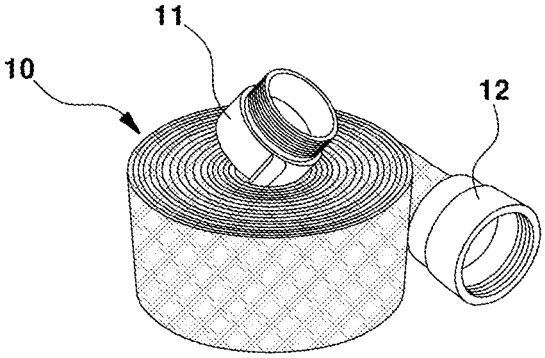
FIGS. 2A and 2B are views illustrating a fire-fighting hose and a spray nozzle which are capable of being connected to a docking unit of a fire suppression apparatus according to an embodiment of the present disclosure.
Figure 2B:
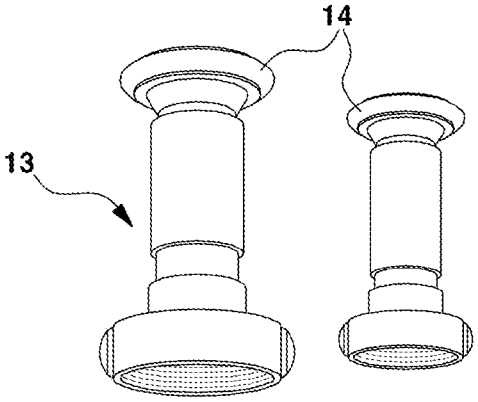

FIG. 1 is a view illustrating a rear flap door of a bus to which a fire suppression apparatus according to an embodiment of the present disclosure is applicable. FIGS. 2A and 2B are views illustrating a fire-fighting hose and a spray nozzle which are capable of being connected to a docking unit of a fire suppression apparatus according to an embodiment of the present disclosure.

Referring to FIG. 1, a rear flap door 2 may be mounted so as to cover an engine room of a bus 1. Here, the engine room is considered to be an interior space in the bus.

The rear flap door 2, which is mounted on the bus 1 so as to hermetically cover the engine room provided in a rear side of the bus 1, is rotatable in an up-and-down direction about a hinge portion of a vehicle body, which is coupled to the upper end of the vehicle body. The rear flap door 2 includes an exterior panel 2*a* of the vehicle body, and further includes a docking unit 20 which will be described in detail later.

Although the rear flap door 2 is illustrated as being mounted on the bus 1, the fire suppression apparatus according to an embodiment of the present disclosure may also be applied to a hood configured to cover an engine room of a passenger automobile.

FIG. 2A illustrates a fire-fighting hose 10, and FIG. 2B illustrates a spray nozzle 13.

The fire-fighting hose 10 illustrated in FIG. 2A may be a fire-fighting hose that is connected to a fire truck so as to allow the fire-fighting water contained in a tank of the fire truck to be supplied therethrough, or a fire-fighting hose that is connected to a fire hydrant provided at a road, a basement, a building or the like.

The spray nozzle 13 may be coupled to a terminal end of the fire-fighting hose 10. The spray nozzle 13 may be coupled to a first coupler 11 provided at the terminal end of the fire-fighting hose 10 such that the fire-fighting water supplied through the fire-fighting hose 10 is sprayed through a nozzle portion 14 which is an outlet of the spray nozzle 13.

Here, the first coupler 11 of the fire-fighting hose 10 is provided on an outer peripheral surface thereof with a threaded portion while the end of the spray nozzle 13 is provided on an inner peripheral surface thereof with a corresponding thread, such that the first coupler 11 of the fire-fighting hose 10 is threadedly coupled to the end of the spray nozzle 13.

The docking unit 20 may be configured so as to allow the first coupler 11 of the fire-fighting hose 10 to be directly threaded thereinto, or to allow the spray nozzle 13 provided at the terminal end of the fire-fighting hose 10 to be fitted thereinto and coupled thereto.

As a fire-fighting hose for a fire truck, two kinds of fire-fighting hoses, having first couplers 11 with different diameters at respective terminal ends thereof, may be used. For example, there may be a fire-fighting hose including a coupler having an outside diameter of 40 mm and a fire-fighting hose including a coupler having an outside diameter of 60 mm.

Accordingly, the fire suppression apparatus according to an exemplary embodiment of the present disclosure is provided with the docking unit 20 to which two types of fire-fighting hoses 10, which include the first couplers 11 having different sizes, that is, different outside diameters, are coupled.

Referring to FIG. 2A, the fire-fighting hose 10 may further include a second coupler 12, which is positioned opposite the first coupler 11 and threadedly coupled to a connecting portion of a fire truck or a fire hydrant.

Figure 3:
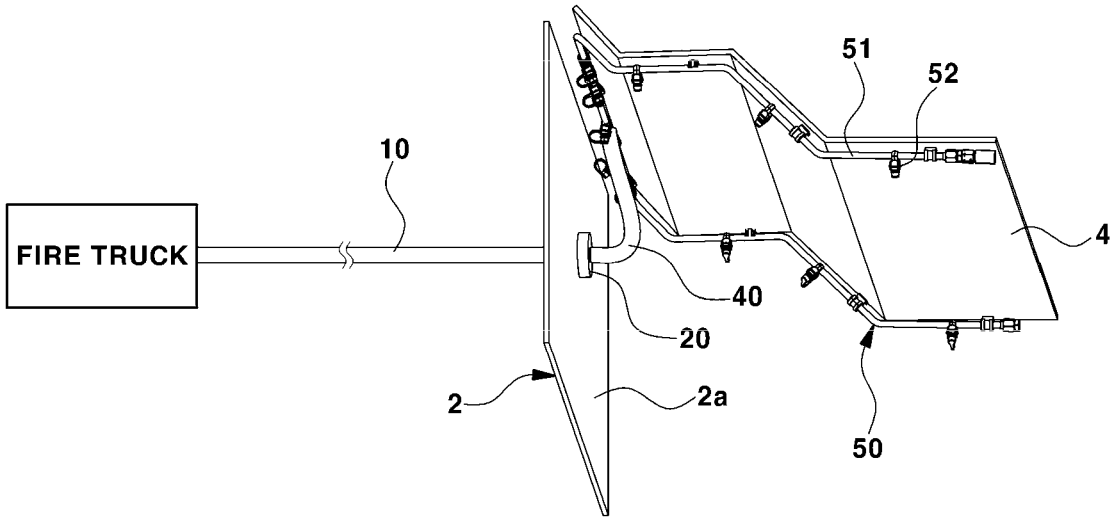
FIGS. 3 and 4 are perspective views illustrating the construction of a fire suppression apparatus according to an embodiment of the present disclosure.
Figure 4:
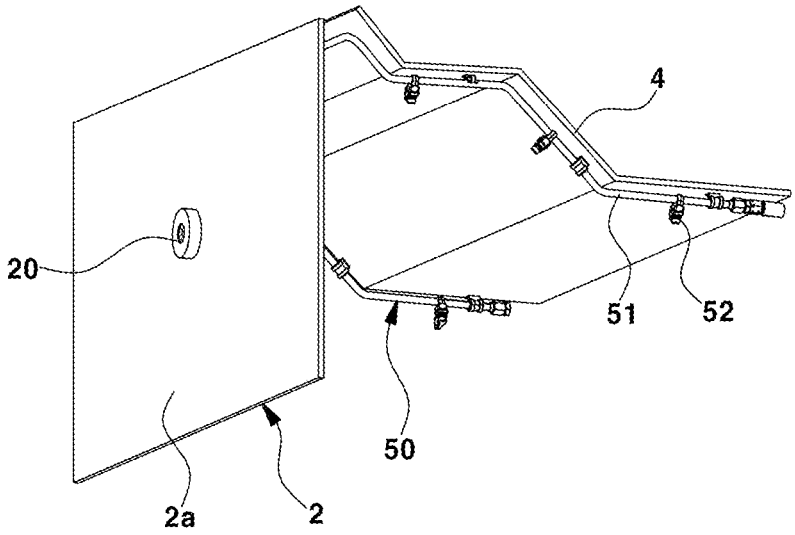

FIGS. 3 and 4 are perspective views illustrating the construction of a fire suppression apparatus according to an exemplary embodiment of the present disclosure, in which the rear flap door 2 and a nozzle assembly 50 are illustrated as being viewed from different angles.

The docking unit 20 illustrated in FIGS. 3 and 4 is the docking unit illustrated in FIGS. 10, 11, 12, 13, 14 and 15, and the docking unit illustrated in FIGS. 7, 8, 9A and 9B is different from the docking unit illustrated in FIGS. 10, 11, 12, 13 and 14.

Figure 5:
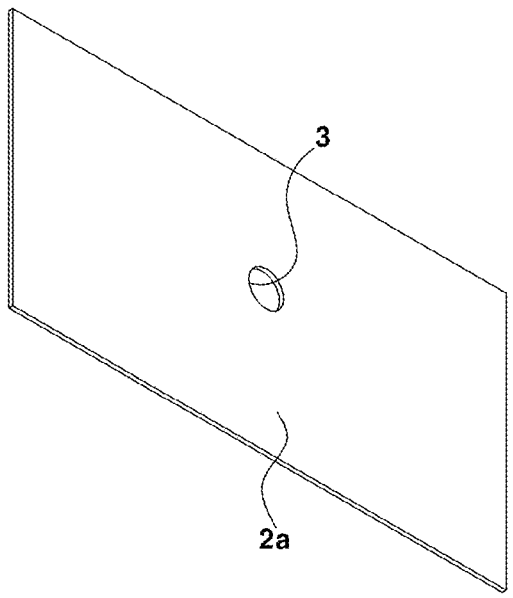
FIG. 5 is a perspective view illustrating a rear flap door on which a docking unit of a fire suppression apparatus according to an embodiment of the present disclosure is mounted.
Figure 6:
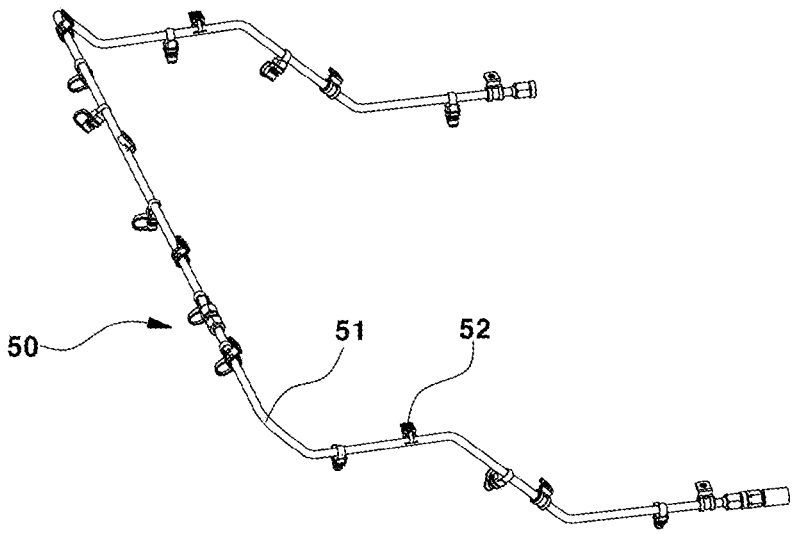
FIG. 6 is a perspective view illustrating a nozzle assembly of a fire suppression apparatus according to an embodiment of the present disclosure.

FIG. 5 is a perspective view illustrating a rear flap door on which a docking unit of a fire suppression apparatus according to an exemplary embodiment of the present disclosure is mounted. FIG. 6 is a perspective view illustrating a nozzle assembly of a fire suppression apparatus according to an exemplary embodiment of the present disclosure.

The docking unit 20, which is mounted on the exterior panel 2*a* of the vehicle that constitutes the rear flap door 2, is provide therein with a hole 3 (see FIG. 5), which is defined through the exterior panel 2*a* of the rear flap door 2 so as to allow the fire-fighting hose 10 or the spray nozzle 13 to be fitted thereinto and coupled thereto. Here, the fire-fighting hose 10 may be connected to a fire truck, or may be connected to a fire hydrant outside the vehicle.

As illustrated in the drawings, the fire-fighting hose 10 connected to the fire truck is coupled to the docking unit 20 provided at the rear flap door 2. Here, the nozzle assembly 50 is fixedly mounted in the engine room, and a supply pipe 40 is positioned between the docking unit 20 and the nozzle assembly 50 and connected thereto.

Although not illustrated in detail in FIGS. 3 and 4, the docking unit 20 may be threadedly coupled to the coupler 11 provided at the terminal end of the fire-fighting hose 10 or the spray nozzle 13 threadedly coupled to the coupler 11 of the fire-fighting hose 10.

Since the rear flap door 2, on which the docking unit 20 is mounted, is rotated in an up-and-down direction so as to open and close the engine room, the supply pipe 40 connected to both the rear flap door 2 and the nozzle assembly 50 may be a flexible hose such that the rear flap door 2 is rotatable in an up-and-down direction without interference therewith.

The nozzle assembly 50 is fixedly mounted in the interior space of the vehicle, that is, the engine room. The supply pipe 40 is connected at one end thereof to the docking unit 20 and at the other end thereof to the inlet of the nozzle assembly 50. The nozzle assembly 50 is configured such that the fire-fighting water, which is supplied through the supply pipe 40 from the fire-fighting hose 10 or the spray nozzle 13 coupled to the docking unit 20, is sprayed toward the inside of the engine room for the purpose of extinguishing the fire in the engine room.

According to the exemplary embodiment of the present disclosure, the nozzle assembly 50 may include a fire-fighting-water pipe 51, which is disposed along a predetermined path in the engine room, and a plurality of nozzles 52, which are provided along the fire-fighting-water pipe 51, as illustrated in FIG. 6.

The fire-fighting-water pipe 51 may be fixedly mounted on a fixed structure disposed in the interior space in the vehicle, for example, the vehicle body 4 positioned in the engine room.

The nozzles 52 of the nozzle assembly 50 are configured to spray the fire-fighting water, which is supplied through the supply pipe 40 and the fire-fighting-water pipe 51 from the fire-fighting hose 10 or the spray nozzle 13, toward the inside of the engine room. Here, the nozzles 52 of the nozzle assembly 50 are provided along the fire-fighting pipe 51 at regular intervals so as to uniformly spray the fire-fighting water toward the inside of the engine room.

Figure 7:
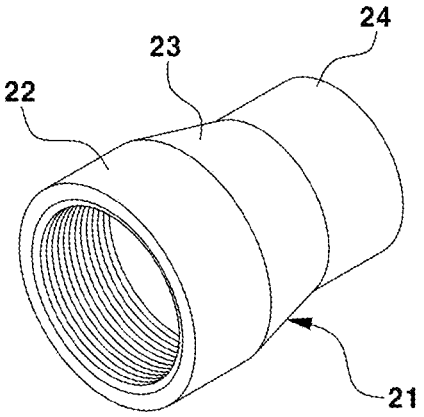
FIG. 7 is a perspective view illustrating a docking coupler of a fire suppression apparatus according to an embodiment of the present disclosure.
Figure 8:
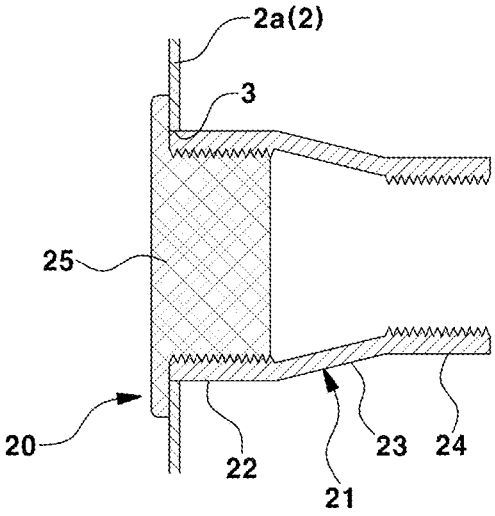
FIG. 8 is a cross-sectional view of a docking coupler of a fire suppression apparatus according to an embodiment of the present disclosure to which a plug is coupled.
Figure 9A:
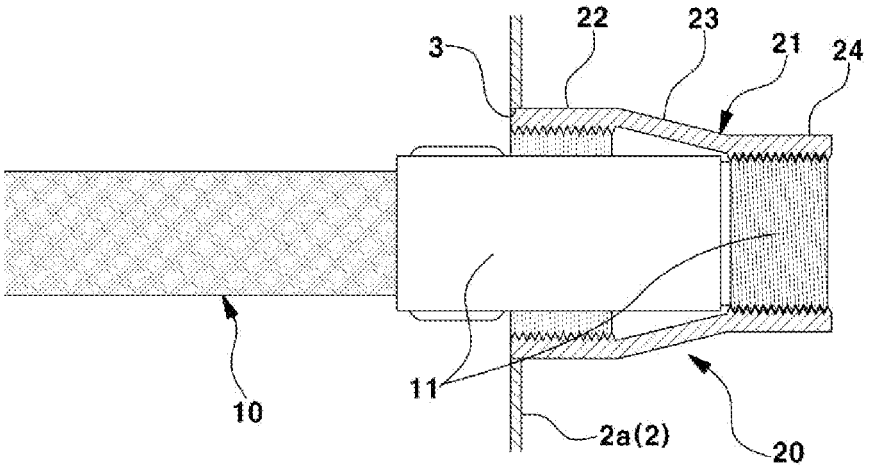
FIGS. 9A and 9B are cross-sectional views of a docking coupler of a fire suppression apparatus according to an embodiment of the present disclosure to which a fire-fighting hose is connected.
Figure 9B:
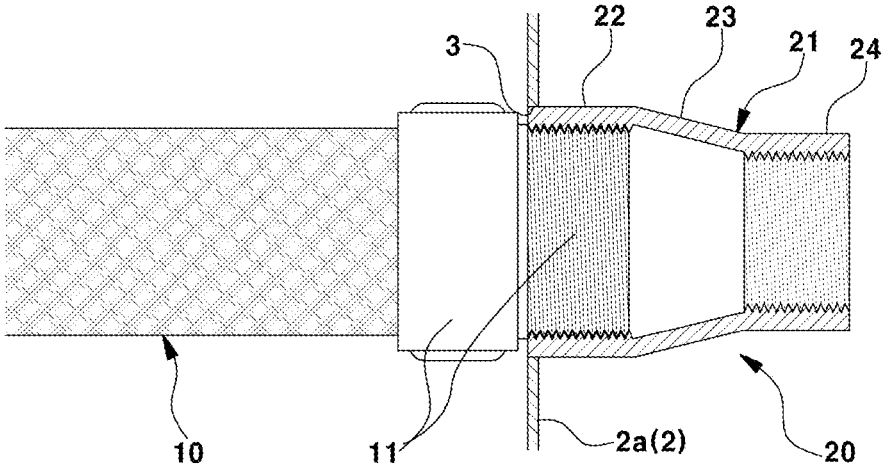

FIG. 7 is a perspective view illustrating a docking coupler of a fire suppression apparatus according to an exemplary embodiment of the present disclosure. FIG. 8 is a cross-sectional view of a docking coupler to which a plug is coupled. FIGS. 9A and 9B are a cross-sectional views of a docking coupler to which a fire-fighting hose is connected.

According to the exemplary embodiment of the present disclosure, the docking unit 20 includes a pipe-shaped docking coupler 21, which is mounted on the rear flap door 2 such that an internal passage thereof communicates with the hole 3 formed in the exterior panel 2*a* of the vehicle, that is, the panel 2*a* of the rear flap door 2.

The docking coupler 21 may be fixedly coupled to the inner surface of the panel 2*a* of the rear flap door 2 through a process such as welding, and may be provided in the inner peripheral surface thereof with a thread into which the fire-fighting hose 10 is threadedly fitted.

According to the exemplary embodiment of the present disclosure, the docking coupler 21 may include a first coupler pipe part 22, which is connected to the hole 3 in the rear flap door 2 such that an internal passage thereof communicates with the hole 3 and an inner peripheral surface of which is threaded, and a second coupler pipe part 24, which is connected to the first coupler pipe part 22 so as to communicate therewith and which has a diameter smaller than the first coupler pipe part 22 and an inner peripheral surface of which is threaded.

Consequently, the fire-fighting hose 10 may be threadedly coupled to the first coupler pipe part 22 or may first pass through an internal passage in the first coupler pipe part 22 and may be threadedly coupled to the second coupler pipe part 24, depending on the diameter of the coupler 11, as illustrated in FIGS. 9A and 9B.

The fire-fighting hose 10, which has a smaller diameter, is threadedly coupled to the second coupler pipe part 24, as illustrated in FIG. 9A, and the fire-fighting hose 10, which has a larger diameter, is threadedly coupled to the first coupler pipe part 22, as illustrated in FIG. 9B.

In this way, one of the first coupler pipe part 22 and the second coupler pipe part 24 may be selected depending on the size of the fire-fighting hose 10, and the fire-fighting hose 10 may then be threadedly coupled to the thread of the selected coupler pipe part.

The docking unit 20 may further include the plug 25, which is releasably coupled to the docking coupler 21 connected to the hole 3 in the rear flap door 2 (the exterior panel of the vehicle) so as to block an internal passage in an inlet portion of the docking coupler 21, as illustrated in FIG. 8.

According the exemplary embodiment of the present disclosure, the plug 25 may be configured so as to be threadedly coupled to the thread of the docking unit 20. For example, the plug 25 may be configured so as to be threadedly coupled to the thread formed in the inner peripheral surface of the first coupler pipe part 22. To this end, the plug 25, which is fitted into the docking coupler 21 of the docking unit 20, is provided on the outer peripheral surface thereof with a thread, which is threadedly coupled to the docking unit 20.

The plug 25 may be made of rubber or the like.

According to the exemplary embodiment of the present disclosure, the docking coupler 21 includes a tapered pipe part 23, which gradually decreases in diameter and connects the first coupler pipe part 22 to the second coupler pipe part 24, as illustrated in FIGS. 7, 8, 9A and 9B.

The papered pipe part 23 is configured so as to decrease in diameter moving toward the second coupler pipe part 24 having a smaller diameter from the first coupler pipe part 22. Consequently, when the coupler 11 of the fire-fighting hose 10 is threadedly coupled to the first coupler pipe part 22, it is possible to prevent a drop in the pressure of the fire-fighting water while the fire-fighting water passes through the tapered pipe part 23 from the fire-fighting hose 10.

The construction of the fire suppression apparatus according to the exemplary embodiment of the present disclosure has been described above. An exemplary process of suppressing fire will now be described.

When the engine room catches fire, the fire in the engine room is detected by a fire detector in the engine room. Then, a signal indicating the fire in the engine room is transmitted to a controller in the vehicle from the fire detector, and the controller wirelessly transmits the signal indicating the outbreak of fire and information about the position of the vehicle to a fire station.

Here, the fire detector is provided at a position at which the fire detector is capable of detecting the outbreak of fire in the engine room. Although various fire detectors for detecting the outbreak of a fire in a vehicle are known in the art, the fire detector according to the exemplary embodiment may be a temperature sensor.

From the signal from the temperature sensor, the controller may determine that the engine room catches fire when the temperature in the engine room increases to a predetermined temperature or higher.

When the signal indicating the outbreak of a fire and the information about the position of the vehicle are transmitted to the fire station, fire fighters alerted to the outbreak of fire and fire trucks arrive at the fire site. Subsequently, one of the fire fighters removes the plug 25 and threadedly couples the fire-fighting hose 10 to the docking coupler 21 of the docking unit 20 of the vehicle.

After the connection of the fire-fighting hose 10, the fire-fighting water in the fire truck is supplied through the fire-fighting hose 10. The fire-fighting water, which is supplied through the fire-fighting hose 10 from the fire truck, is sprayed toward the inside of the engine room through the docking unit 20, the supply pipe 40, the fire-fighting pipe 51 and the nozzles 52, thereby suppressing the fire in the engine room.

Although the fire-fighting hose 10 has been described as being a fire hose connected to a fire truck, the fire-fighting hose 10 may be a fire-fighting hose connected to a fire hydrant rather than a fire hose connected to a fire truck.

FIGS. 10, 11, 12, 13, 14 and 15 are views illustrating the construction of a docking unit of a fire suppression apparatus according to another embodiment of the present disclosure. The docking unit 20 according to this embodiment illustrated FIGS. 10, 11, 12, 13, 14 and 15 differs in construction from the docking unit 20 according to the embodiment illustrated in FIGS. 7, 8, 9A and 9B.

As illustrated in the drawings, the docking unit 20 according to another embodiment illustrated in FIGS. 10, 11, 12, 13, 14 and 15 includes a casing 26, which is fixedly mounted on the inner surface of the rear flap door 2 such that the interior space thereof communicates with the hole 3 in the exterior panel 2*a* of the vehicle body, that is, the hole 3 formed through the rear flap door 2.

The casing 26 is configured such that the spray nozzle 13 extends through an internal passage thereof. The casing 26 may be a cylindrical casing having an interior space of a predetermined volume. The casing 26 may have an inlet hole 27*a*, which is defined in a center of a front wall 27, which is closely coupled to the inner surface of the rear flap door 2, and an outlet hole 28*a*, which is defined in the center of a rear wall 28 opposite the front wall 27.

The casing 26 is mounted such that the inlet hole 27*a* in the casing 26 is aligned with the hole 3 in the exterior panel 2*a* of the vehicle body, that is, the hole 3 formed through the rear flap door 2, while the front wall 27 of the casing 26 is coupled to an inner surface of the rear flap door 2.

The docking unit 20 further includes an opening unit 29, which is provided in the interior space in the casing 26 so as to open and close the hole 3 in the rear flap door 2 and the inlet hole 27*a* in the casing 26 which communicates with the hole 3, and a support pipe 38, which is fixedly coupled to the outer portion of the casing 26 such that the internal passage thereof communicates with the outlet hole 28*a* in the casing 26.

According to another exemplary embodiment of the present disclosure, the support pipe 38 is connected at one end thereof to the outlet hole 28*a* in the casing 26 and at the other end thereof to the supply pipe 40 (see FIG. 3). Since the supply pipe 40 is connected to the nozzle assembly 50, the fire-fighting water, which is sprayed from the spray nozzle fitted in the support pipe 38, is supplied to the nozzle assembly 50 through the supply pipe 40.

Although a separate support pipe 38 may be provided as in another exemplary embodiment, the support pipe 38 may be a portion of the supply pipe 40. In this case, the end of the supply pipe 40 is directly connected to the outlet hole 28*a* in the casing 26.

Figure 10:
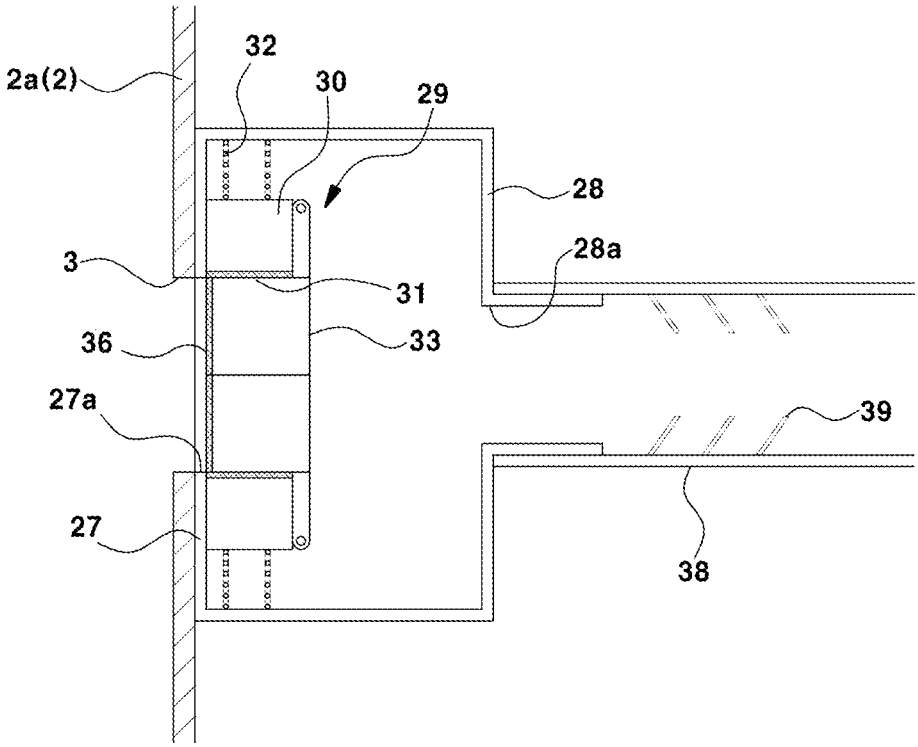
FIGS. 10, 11, 12, 13, 14 and 15 are views illustrating the construction of a docking unit of a fire suppression apparatus according to another embodiment of the present disclosure.
Figure 11:
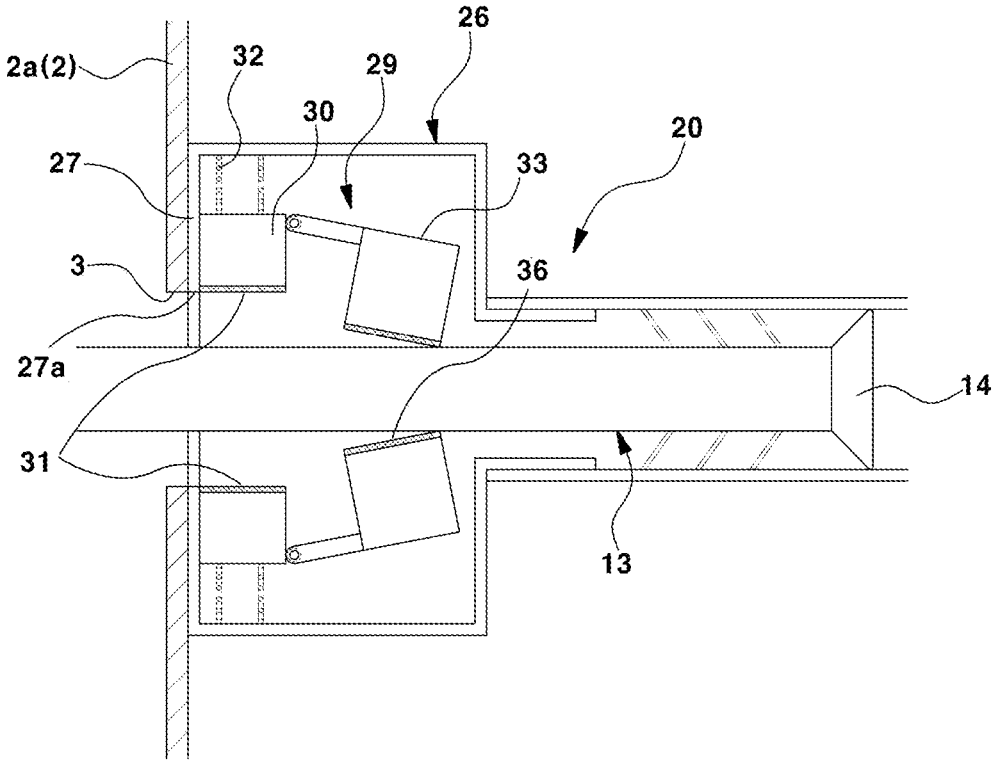

According to another exemplary embodiment of the present disclosure, the support pipe 38 may be made of rubber. As illustrated in FIGS. 10 and 11, the support pipe 38 (or the supply pipe) may be provided on the inner peripheral surface thereof with a plurality of lips 39, which are in close contact with the outer peripheral surface of the spray nozzle 13 so as to support the spray nozzle 13 fitted into the internal passage thereof, to realize sealable engagement with the spray nozzle 13 and to prevent separation of the spray nozzle 13 fitted therein and backflow of the fire-fighting water.

For coupling with the docking unit 20, the opening unit 29 may be constructed so as to be operated by the pushing force of the spray nozzle 13, which passes through the hole 3 in the rear flap hole 2.

According to another exemplary embodiment of the present disclosure, the opening unit 29 may include a plurality of first bodies 30, which are arranged in the casing 26 in a circumferential direction of the inlet hole 27*a*, a plurality of elastic elements 32, which are respectively disposed between the inner surface of the casing 26 and the plurality of first bodies 30 so as to elastically support the first bodies 30 with respect to the casing 26, and a plurality of second bodies 33, which are rotatably and hingedly coupled to the respective first bodies 30 so as to open or close the inlet hole 27*a* in the casing 26 depending on the rotational angle thereof with respect to the first bodies 30.

Each of the plurality of first bodies 30 may be curved on one surface thereof, and the curved surface may be provided with a pad 31. When the plurality of first bodies 30 are mounted in the interior space in the casing 26, the curved surfaces of the first bodies 30 and the pads 38 collectively define a cylindrical guide surface around the inlet hole 27*a* in the casing 26, as illustrated in FIG. 11.

Each of the elastic elements 32 may be a coil spring, which is fixed at one end thereof to the inner peripheral surface of the casing 26 and at the other end thereof to a corresponding one of the first bodies 30. In this case, the coil springs, serving as the elastic elements 32, are disposed so as to elastically support the first bodies 30 in a radial and inward direction of the casing 26.

Figure 12:
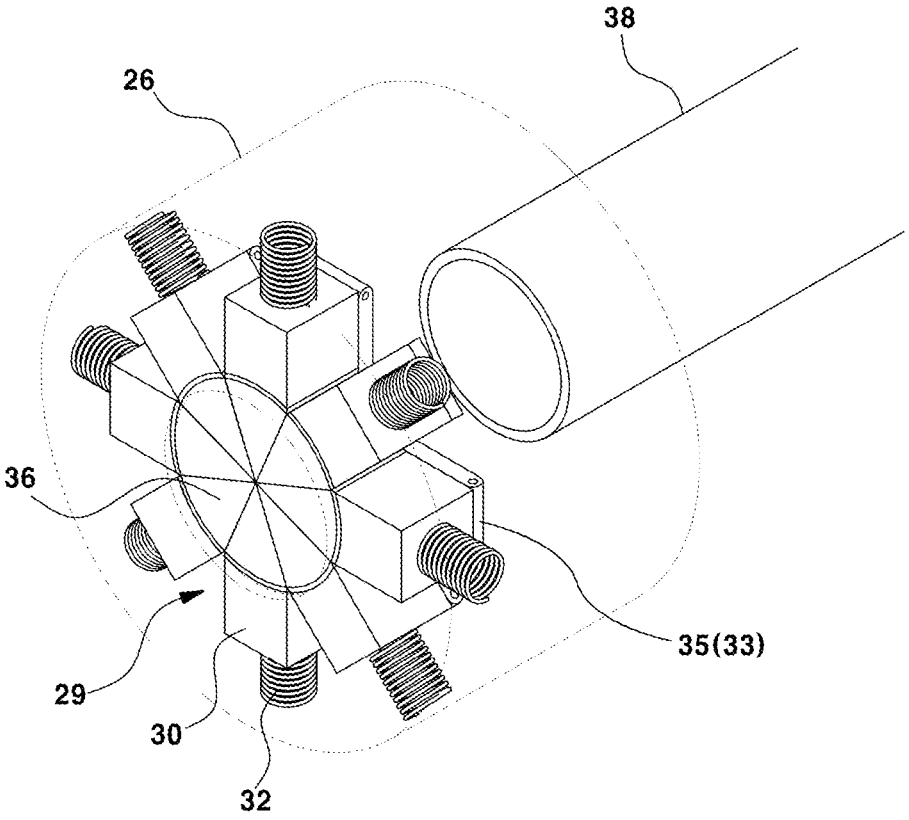
Figure 14:
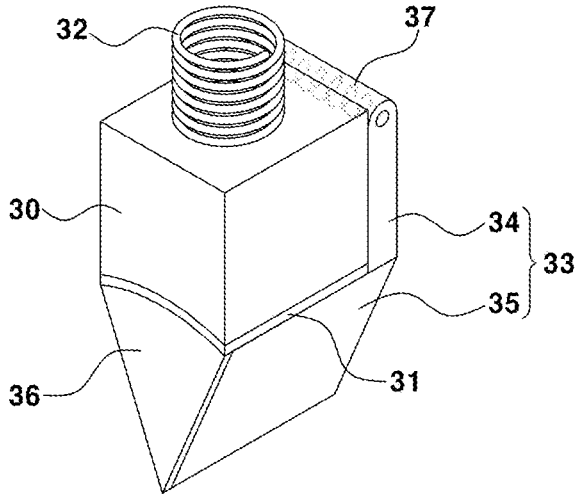

As illustrated in FIGS. 12 and 14, when the plurality of second bodies 33 are rotated so as to be fitted into the cylindrical guide surface, which is defined by the plurality of first bodies 30, the plurality of second bodies 33 close the inlet hole 27*a* in the casing 26.

Figure 13:
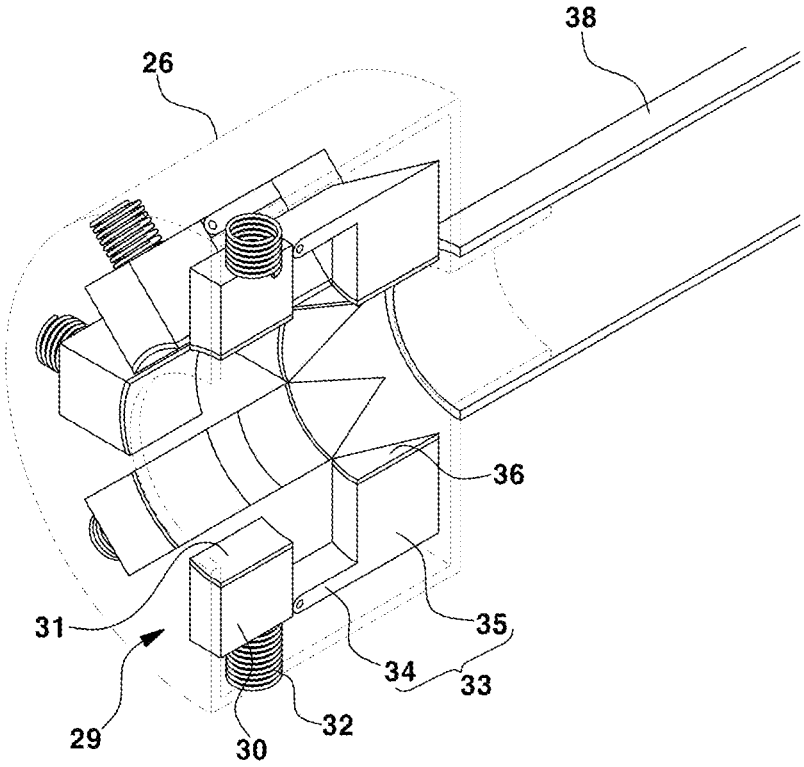
Figure 15:
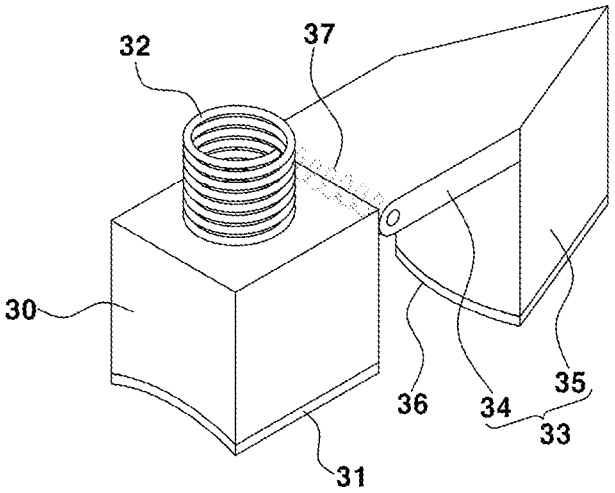

As illustrated in FIGS. 13 and 15, when the plurality of second bodies 33 are respectively rotated in the opposite direction from the first bodies 30, the plurality of second bodies 33 open the inlet hole 27*a* in the casing 26.

Although FIGS. 13 and 15 illustrate the second bodies 33, which are maximally rotated from the first bodies 30, the second bodies 33 are maintained in the open state while being in contact with the spray nozzle 13, as illustrated in FIG. 11. Accordingly, even when the spray nozzle 13 is fitted into the support pipe 38, the second bodies 33 are not positioned in the maximally rotated state, as illustrated in FIGS. 13 and 15.

In other words, as illustrated in FIG. 11, when the spray nozzle 13 is fitted into the support pipe 38 through the inside of the casing 26, the second bodies 33 are in contact with the outer peripheral surface of the spray nozzle 13 in the rotated state.

According to the exemplary embodiment of the present disclosure, each of the plurality of first bodies 30 may be hingedly coupled to a corresponding one of the plurality of second bodies 33 via a hinge pin. Here, the hinge portion between the first bodies 30 and the second bodies 33 may be provided with a return spring 37.

The return spring 37 offers elastic restoring force, which is required to rotate the second bodies 33 from the first bodies 30 to the closed state or position shown in FIGS. 10 and 12. Consequently, when the spray nozzle 13 is fitted into the support pipe 38 through the inside of the casing 26, the second bodies 33 are in contact with the outer peripheral surface of the spray nozzle 13, as illustrated in FIG. 11.

In other words, when the spray nozzle 13 connected to the terminal end of the fire-fighting hose 10 is fitted into the casing 26 through the inlet hole 27*a* in the casing 26, the spray nozzle 13 pushes all of the second bodies 33, which are in the closed position. At this time, the second bodies 33 are rotated from the first bodies 30 while overcoming the elastic force of the return springs 37.

The spray nozzle 13 enters the inside of the casing 26 and then passes through the cylindrical guide surface, which is defined by the first bodies 30. Subsequently, the spray nozzle 13 rotates the second bodies 33. As the second bodies 33 are rotated, the return springs 37 are deformed while accumulating elastic force therein.

According to another exemplary embodiment of the present disclosure, each of the second bodies 33 may include a plate-shaped connecting bridge 34, which is hingedly coupled to the first bodies 30, and a body block 35, which is integrally formed with the connecting bridge 34 and which is fitted into the cylindrical guide surface so as to close the inlet hole 27*a* in the casing 26 when the second bodies 33 are rotated to the closed position.

The body block 35 may be provided on one surface thereof with a curved surface, which is brought into close contact with the curved surface of the first bodies 30 when the body block 35 is in the closed position.

The second bodies 33 may also be provided on another surface thereof with a curved surface, which is brought into contact with the outer peripheral surface of the spray nozzle 13 when the second bodies 33 are rotated so that the spray nozzle 13 opens the inlet hole 27*a* in the casing 26.

One surface, which is curved, of each of the first bodies 30 constituting the cylindrical guide surface, may be provided with a rubber pad 31, and another surface of each of the second bodies 33 may also be provided with a rubber pad 36.

Consequently, since the docking unit 20 illustrated in FIGS. 10, 11, 12, 13, 14 and 15 includes the opening unit 29, which is configured to open and close the hole 3 in the exterior panel 2*a* of the vehicle body, that is, the hole formed through the rear flap door 2, and the inlet hole 27*a* in the casing 26, there is no need for the plug 25 illustrated in FIG. 8.

In the docking unit 20 illustrated in FIGS. 10, 11, 12, 13, 14 and 15, when the spray nozzle 13 connected to the fire-fighting hose 10 is brought into contact with the pads 36 of the body blocks 35 through the hole 3 in the rear flap door 2 to fight the fire and is then pushed toward the pads 36 of the body blocks 35, the second bodies 33 are rotated while overcoming the elastic force of the return springs 37, thereby opening the inlet hole 27*a* in the casing 26.

As the second bodies 33 are rotated by the spray nozzle 13, which is fitted into the casing 26, the pads 36 provided at the body blocks 35 are brought into contact with the spray nozzle 13. Subsequently, as the second bodies 33 are further fitted, the second bodies 33 are further rotated by the spray nozzle 13, which is further fitted, thereby opening the hole 3.

Thereafter, when the spray nozzle 13 is fitted into the support pipe 38 through the second bodies 33 and then passes through the lips 39 in the support pipe 38, the lips 39 support the spray nozzle 13 in the state of being in close contact with the outer peripheral surface of the spray nozzle 13.

When the fire-fighting water is discharged through the spray nozzle 13, the fire-fighting water is supplied to the nozzle assembly 50 through the supply pipe 40. Subsequently, the fire-fighting water flows along the fire-fighting pipe 51 from the nozzle assembly 50 and is sprayed toward the inside of the engine room through the nozzle 52, thereby suppressing the fire.

As is apparent from the above description, the fire suppression apparatus according to the present disclosure makes it easy to quickly and efficiently respond to the outbreak of a fire in an interior space of a vehicle such as an engine room by simply connecting the fire-fighting hose or the spray nozzle to the docking unit without opening a flap door of the vehicle.

The disclosure has been described in detail with reference to embodiments thereof. However, it will be appreciated by those skilled in the art that changes may be made in these embodiments without departing from the principles and spirit of the disclosure, the scope of which is defined in the appended claims and their equivalents.

What is claimed is:

1. A fire suppression apparatus for a vehicle comprising:

a docking unit disposed on an exterior panel of a vehicle body, the docking unit being installed on the exterior panel configured to cover an interior space of the vehicle, the docking unit having a hole through which a fire-fighting hose for supply of a fire-fighting water or a spray nozzle connected to the fire-fighting hose passes;

a supply pipe having a first end connected to the docking unit; and a nozzle assembly arranged in the interior space of the vehicle and connected to a second end of the supply pipe, the nozzle assembly configured to spray the fire-fighting water, which is supplied through the supply pipe from the fire-fighting hose or the spray nozzle, to extinguish a fire in the interior space of the vehicle in case of fire, wherein the docking unit includes a docking coupler having a pipe shape and coupled to the exterior panel of the vehicle body such that an internal passage of the docking coupler communicates with the hole, wherein the internal passage of the docking unit comprises a thread on an inner peripheral surface thereof configured to couple with the fire-fighting hose, wherein the docking coupler includes:

a first coupler pipe part extending through and communicating with the hole, the first coupler pipe part having a thread on an inner peripheral surface thereof; and a second coupler pipe part connected and communicating with the first coupler pipe part, the second coupler pipe part having a diameter smaller than that of the first coupler pipe part and having a thread on an inner peripheral surface thereof.

2. The fire suppression apparatus of claim 1, wherein the interior space of the vehicle is configured as an engine room.

3. The fire suppression apparatus of claim 2, wherein the vehicle includes a bus, and the exterior panel of the vehicle body is a flap door configured to open and close an engine room of the bus.

4. The fire suppression apparatus of claim 2, wherein the vehicle includes a passenger automobile, and the exterior panel of the vehicle body is a hood configured to open and close an engine room of the passenger automobile.

5. The fire suppression apparatus of claim 1:

wherein the fire-fighting hose is configured to be threadedly coupled to the thread of the first coupler pipe part or threadedly coupled to the thread of the second coupler pipe part through an internal passage in the first coupler pipe part.

6. The fire suppression apparatus of claim 1, wherein the docking unit includes a plug configured to be releasably coupled to the hole and to an inlet of the docking coupler communicating with the hole, the plug configured to close the hole and the inlet of the docking coupler.

7. The fire suppression apparatus of claim 1, wherein the nozzle assembly includes a plurality of nozzles provided along a fire-fighting pipe at regular intervals so as to uniformly spray the fire-fighting water toward an inside of an engine room.

8. A fire suppression apparatus for a vehicle comprising:

a docking unit disposed on an exterior panel of a vehicle body, the docking unit being installed on the exterior panel configured to cover an interior space of the vehicle, the docking unit having a hole through which a fire-fighting hose for supply of a fire-fighting water or a spray nozzle connected to the fire-fighting hose passes;

a supply pipe having a first end connected to the docking unit; and a nozzle assembly arranged in the interior space of the vehicle and connected to a second end of the supply pipe, the nozzle assembly configured to spray the fire-fighting water, which is supplied through the supply pipe from the fire-fighting hose or the spray nozzle, to extinguish a fire in the interior space of the vehicle in case of fire, wherein the docking unit includes:

a casing configured to be coupled to the exterior panel of the vehicle body such that an interior space of the casing communicates with the hole and the spray nozzle passes through the casing;

an opening unit arranged in the interior space of the casing, the opening unit configured to open and close the hole and an inlet hole of the casing communicating with the hole, wherein the opening unit is configured to be opened by pushing force of the spray nozzle which passes through the hole; and a support pipe configured to be coupled to the casing such that an internal passage of the support pipe communicates with an outlet hole of the casing and is configured to accommodate the spray nozzle, the support pipe being connected to the second end of the supply pipe.

9. The fire suppression apparatus of claim 8, wherein the support pipe has a lip on an inner surface thereof, the lip configured to be in contact with an outer peripheral surface of the spray nozzle so as to support the spray nozzle fitted into the internal passage of the support pipe, wherein the lip is configured to seal the spray nozzle to prevent backflow of the fire-fighting water.

10. The fire suppression apparatus of claim 8, wherein the opening unit includes:

a plurality of first bodies arranged in the interior space of the casing in a circumferential direction of the inlet hole, inner surfaces of the plurality of first bodies configured to define a guide surface;

a plurality of elastic elements arranged between the casing and the respective plurality of first bodies so as to elastically support the first bodies with respect to the casing; and a plurality of second bodies configured to be rotatably and hingedly coupled to the respective first bodies, the plurality of second bodies configured to selectively open or close the inlet hole of the casing depending on a rotational angle of the plurality of second bodies with respect to the plurality of first bodies.

11. The fire suppression apparatus of claim 10, wherein each of the plurality of elastic elements is a coil spring, a first end of which is configured to be coupled to an inner circumferential surface of the casing having a cylindrical shape and a second end of which is configured to be coupled to a corresponding one of the plurality of first bodies so as to support the plurality of first bodies with elasticity in an inward direction of the casing.

12. The fire suppression apparatus of claim 10, wherein each of the plurality of second bodies includes:

a connecting bridge having a plate shape and configured to be hingedly coupled to a corresponding one of the plurality of first bodies and;

a body block configured to be integrally formed with the connecting bridge, the body block being in close contact with the guide surface so as to close the inlet hole of the casing when the plurality of second bodies are rotated.

13. The fire suppression apparatus of claim 10, wherein the plurality of first bodies have rubber pads on the inner surfaces, respectively, thereof, and wherein the plurality of second bodies, which are brought into contact with the spray nozzle when the plurality of second bodies are rotated, comprise rubber pads, respectively.

14. The fire suppression apparatus of claim 10, wherein the opening unit further includes return springs at a hinge portion between the plurality of first bodies and the plurality of second bodies, the return springs are configured to provide elastic restoring force in a direction in which the plurality of second bodies are rotated to a closed position from the plurality of first bodies.

* * * * *